US007621264B2

(12) United States Patent
Balsdon

(10) Patent No.: US 7,621,264 B2
(45) Date of Patent: Nov. 24, 2009

(54) CARTRIDGE STYLE EXHAUST BYPASS VALVE

(75) Inventor: David W. Balsdon, Chatham (CA)

(73) Assignee: Continental Automotive Canada, Inc., Ontario (CA)

( * ) Notice: Subject to any disclaimer, the term of this patent is extended or adjusted under 35 U.S.C. 154(b) by 220 days.

(21) Appl. No.: 11/898,963

(22) Filed: Sep. 18, 2007

(65) Prior Publication Data

US 2008/0072865 A1 Mar. 27, 2008

Related U.S. Application Data

(60) Provisional application No. 60/826,480, filed on Sep. 21, 2006.

(51) Int. Cl.
*F02M 25/07* (2006.01)
*F02B 47/08* (2006.01)

(52) U.S. Cl. ..... 123/568.12; 123/568.24

(58) Field of Classification Search ..... 123/568.11, 123/568.12, 568.21, 568.23, 568.24; 251/129.11–129.13; 60/320, 324, 605.2
See application file for complete search history.

(56) References Cited

U.S. PATENT DOCUMENTS 4,433,666 A * 2/1984 Masaki et al. ..... 123/568.22
5,740,785 A * 4/1998 Dickey et al. ..... 123/568.12
6,205,785 B1 * 3/2001 Coleman ..... 60/605.2
7,007,680 B2 * 3/2006 Tussing et al. ..... 123/568.12
7,163,005 B2 * 1/2007 Tussing et al. ..... 123/568.12
7,438,062 B2 * 10/2008 Okawa et al. ..... 123/568.12
2006/0174611 A1 * 8/2006 Dilley et al. ..... 60/320
2007/0289581 A1 * 12/2007 Nakamura ..... 123/568.12
2008/0289611 A1 * 11/2008 Modien ..... 123/568.12

FOREIGN PATENT DOCUMENTS

DE 10341393 B3 * 9/2004 ..... 123/568.12

* cited by examiner

*Primary Examiner*—Willis R Wolfe, Jr.

(57) ABSTRACT

An exhaust bypass valve assembly is provided for a vehicle. The assembly includes a housing (22) defining an inlet passageway (21) and first and second passageways (24, 26) in communication with the inlet passageway and with each other, and a bore (28) at a juncture (25) of the passageways and in communication with the passageways. The inlet passageway is associated with an exhaust manifold, the first passageway is associated with a cooler of a vehicle, and the second passageway is associated with an engine of a vehicle. An exhaust bypass valve cartridge (30) includes a valve member (32) removably disposed in the bore of the housing, and shaft structure (40, 42) associated with the valve member so that rotation of the shaft structure rotates the valve member. The valve member is movable between first and second positions to control the flow of exhaust gas flow from the inlet passageway through the first and second passageways.

10 Claims, 3 Drawing Sheets

CARTRIDGE STYLE EXHAUST BYPASS VALVE

This application claims the benefit of the earlier filing date of U.S. Provisional Application No. 60/826,480, filed on Sep. 21, 2006, which is hereby incorporated by reference into this specification.

FIELD OF THE INVENTION

This invention relates to an Exhaust Bypass Valve (EBV) for diesel engines and more particularly, to a cartridge style EBV.

BACKGROUND OF THE INVENTION

In general, when diesel fuel is burned in an engine, nitrogen oxides are produced in the exhaust gas. An exhaust gas recirculation (EGR) cooler provides a cooled dilutent to lower combustion temperatures and reduce the concentration of nitrogen oxides in the exhaust gases. Typically, when an engine is first started, an EBV assembly, separate from the EGR cooler, is used to bypass the EGR cooler and redirect uncooled gasses through the engine to accelerate engine warmup. These EBV assemblies must withstand high temperature and are typically complicated, with an expensive, machined housing.

With reference to FIG. 1, a conventional EBV assembly, generally indicated at 10, includes the conventional pair of butterfly valves 14, 14' disposed on a common shaft 15. A conventional motor-driven, general purpose actuator (not shown), is provided to control operation of the butterfly valves 14, 14' to open and close a bypass passageway 18. Thus, since two valves and two sealing surfaces are required, the EBV assembly 10 is large and costly.

Thus, there is a need to provide a compact, replaceable and cost-effective EBV.

SUMMARY OF THE INVENTION

An object of the invention is to fulfill the need referred to above. In accordance with the principles of the present invention, this objective is obtained by providing an exhaust bypass valve cartridge for an exhaust bypass valve (EBV) assembly. The EBV assembly has a housing defining an inlet passageway and first and second passageways in communication with the inlet passageway and with each other, and a bore at a juncture of the passageways and in communication with the passageways. The cartridge includes a valve member constructed and arranged to be removably inserted into the bore of the housing, and shaft structure associated with the valve member so that rotation of the shaft structure rotates the valve member. When the valve member is in a first position, the inlet passageway communicates only with the first passageway, and when the valve member is in a second position, the inlet passageway communicates only with the second passageway.

In accordance with another aspect of the invention, an exhaust bypass valve assembly is provided for a vehicle. The assembly includes a housing defining an inlet passageway and first and second passageways in communication with the inlet passageway and with each other, and a bore at a juncture of the passageways and in communication with the passageways. The inlet passageway is constructed and arranged to receive exhaust gas from an exhaust manifold of a vehicle, the first passageway is constructed and arranged to be associated with a cooler of the vehicle, and the second passageway is constructed and arranged to be associated with an engine of the vehicle. An exhaust bypass valve cartridge includes a valve member removably disposed in the bore of the housing, and shaft structure associated with the valve member so that rotation of the shaft structure rotates the valve member. The valve member is movable between first and second positions such that when the valve member is in the first position, the inlet passageway only communicates with the first passageway so that exhaust gas can be directed to the cooler, and when the valve member is in a second position, the inlet passageway only communicates with the second passageway so that exhaust gas can be directed to the engine.

In accordance with yet another aspect of the invention, a method of providing a removable exhaust bypass valve cartridge for an exhaust bypass valve assembly of a vehicle provides a housing defining an inlet passageway and first and second passageways in communication with the inlet passageway and with each other, and a bore at a juncture of the passageways and in communication with the passageways. The inlet passageway receives exhaust gas, the first passageway is associated with a cooler of a vehicle and the second passageway is associated with an engine of a vehicle. An exhaust bypass valve is provided as a cartridge. The cartridge, includes a valve member and shaft structure associated with the valve member so that rotation of the shaft structure moves the valve member. The valve member is inserted into the bore in such a manner that the valve member is removable from the bore, with the shaft structure being accessible to be rotated such that rotation of the shaft moves the valve member to control a flow of exhaust gas from the inlet passageway through the first and second passageways.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
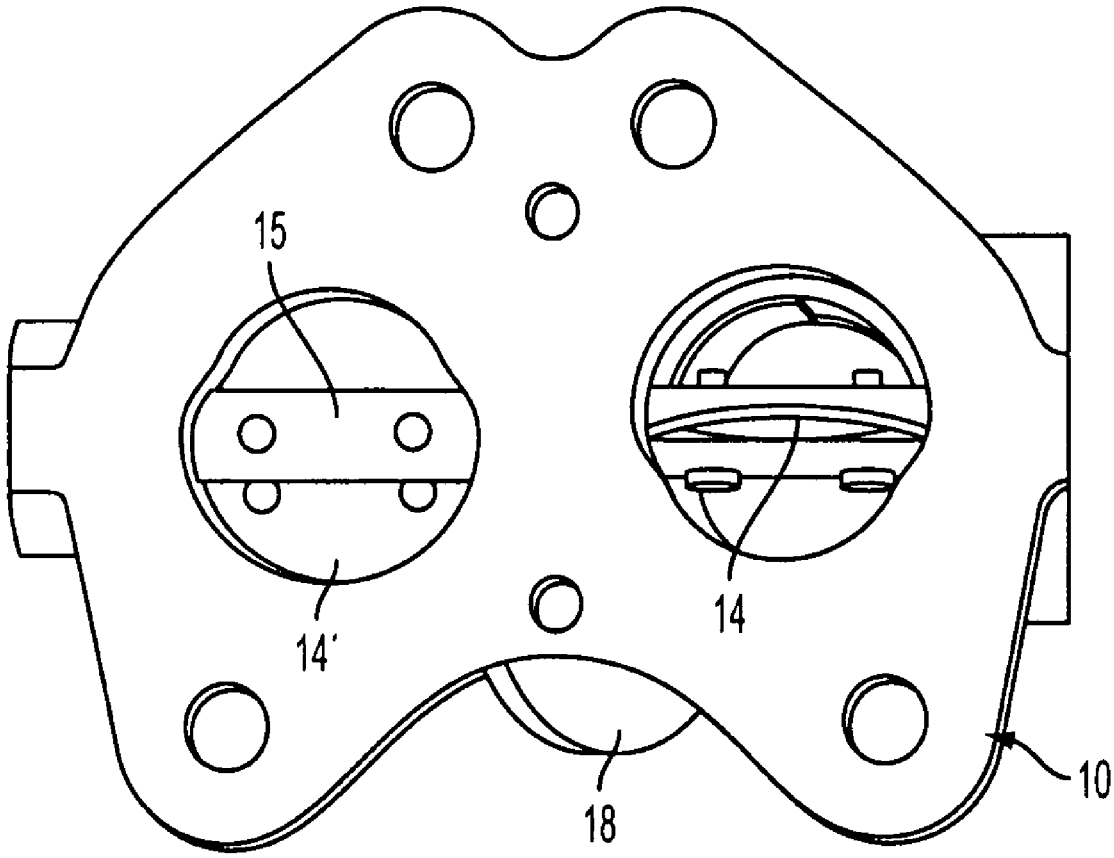
FIG. 1 PRIOR ART
FIG. 1 is a view of a conventional EBV assembly having dual butterfly valves.
Figure 2:
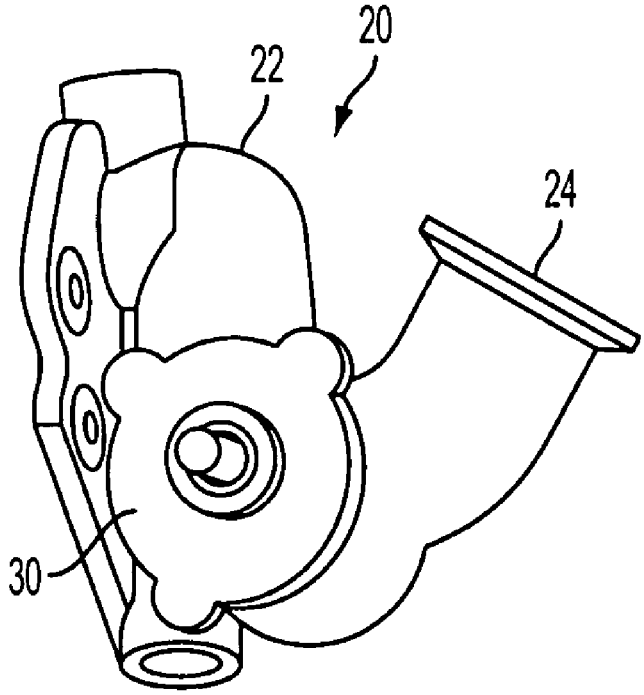
FIG. 2 is view of an EBV assembly including a housing and EBV, in accordance with an embodiment of the invention, shown mounted to the housing.

Referring to FIG. 2, an Exhaust Bypass Valve (EBV) assembly for a diesel engine is shown, generally indicated at 20, in accordance with an embodiment of the invention. The assembly 20 is constructed and arranged to be mounted with respect to an exhaust gas cooler of an exhaust manifold of, for example, a diesel engine (none of which are shown). For example, the assembly 20 can be mounted after the cooler such that exhaust gas enters from the back of an exhaust manifold into the cooler during a 'cooler' mode and bypasses the cooler during a 'hot' or bypass mode by using the external manifold as the bypass tube. The gas exits the exhaust manifold at the front, bypassing the cooler, entering directly into the assembly 20. The assembly 20 can be mounted before the cooler in certain configurations. The assembly is used in bypass mode during 1) cold start conditions to reduce the time it takes to bring the engine up to temperature by 'dumping' hot exhaust gas into the intake manifold and 2) DPF regeneration. In the cooler mode, the assembly 20 reduces exhaust gas recirculation temperature to increase air density and improve combustion and emissions.

Figure 4:
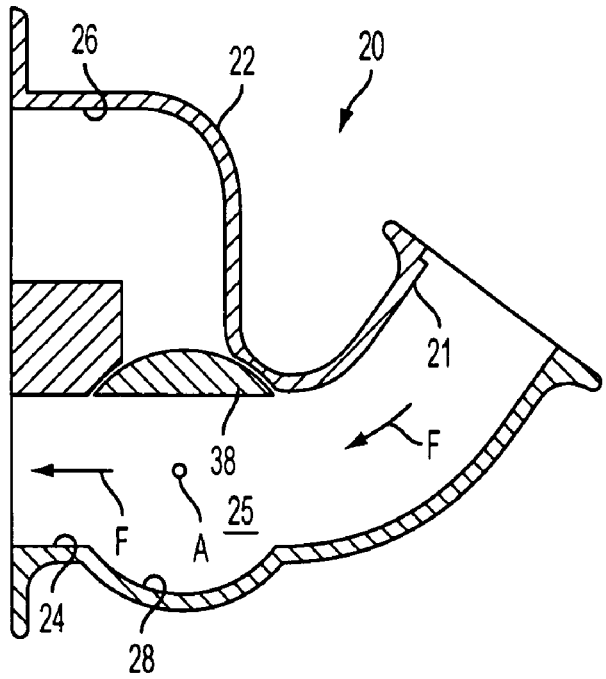
FIG. 4 is a sectional view of FIG. 2 showing the valve member of the EBV in a cooler mode position.

In the embodiment and with reference to FIGS. 2 and 4, the assembly 20 includes housing 22 having an inlet passageway 21, and a first passageway 24 in communication with a second passageway 26. The inlet passageway communicates with the first and second passageways and is constructed and arranged to receive exhaust gas from an exhaust manifold of a vehicle. The first passageway 24 is constructed and arranged to communicate with a cooler (not shown), and the second passageway 26 is constructed and arranged to communicate with an engine (not shown).

Figure 3:
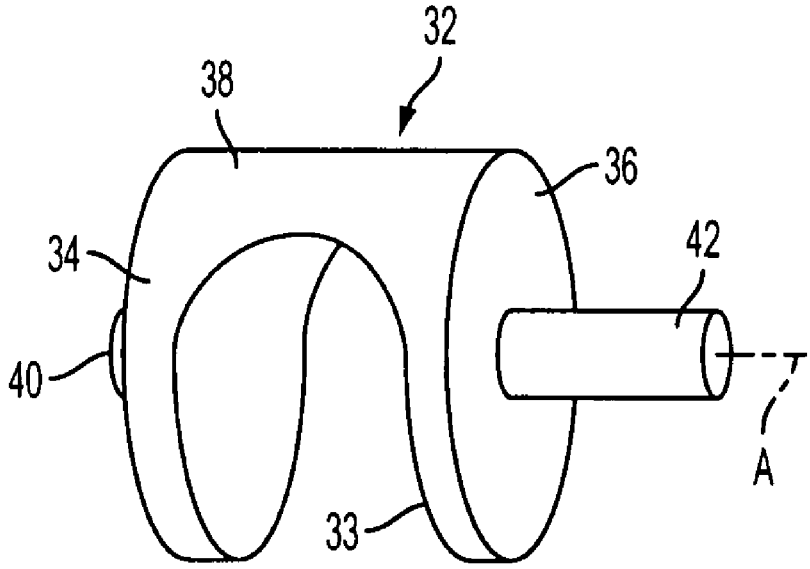
FIG. 3 is a view of the valve member of the EBV of FIG. 2.

At a juncture 25 of the passageways 21, 24, 26, the housing 22 includes a generally cylindrical bore 28 therein so as to communicate with each of the passageways 21, 24, 26. The assembly 20 includes an EBV cartridge, generally indicated at 30, received in the bore 28. With reference to FIG. 3, the EBV cartridge 30 includes a valve member, generally indicated at 32. In the embodiment, the valve member 32 is generally cylindrical having a cutout 33 that defines a generally U-shape of the valve member 32. Thus, the valve member 32 has a pair or sides 34, 36 and a valve portion 38 joined between the two sides. A shaft structure is provided and in the embodiment is defined by shafts 40, 42 associated with each side 34, 36, respectively. Shaft 42 is coupled with an actuator (not shown) in the conventional manner to actuate (rotate) the valve member.

Thus, as shown in FIG. 4, when the valve member 32 is rotated about axis A to a cooler mode position, the valve portion 38 substantially bocks passageway 26 such that exhaust gas recirculation flow F from an exhaust manifold flows through the inlet passageway 21, through the cutout 33 in the valve member 32, and through the passageway 24 to an exhaust gas recirculation (EGR) cooler that provides a cooled dilutent to lower combustion temperatures and reduce the concentration of nitrogen oxides in the exhaust gases.

Figure 5:
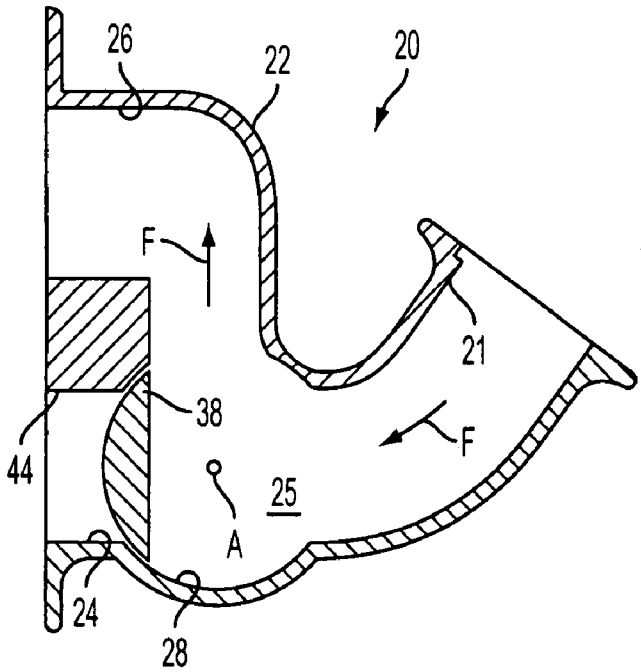
FIG. 5 is a sectional view of FIG. 2 showing the valve member of the EBV in a bypass mode position.

With reference to FIG. 5, when the valve member 32 is rotated about axis A to a bypass mode position, the valve portion 38 substantially bocks passageway 24 such that exhaust gas recirculation flow F from the exhaust manifold flows through the inlet passageway 21, through the cutout 33 in the valve member 32, and through passageway 26, bypassing the EGR cooler, which redirects uncooled gasses through the engine to accelerate engine warmup.

Since the EBV cartridge 30 is selectively removable, a defective EBV cartridge 30 can simply be removed and replaced. Since a single valve member 32 is used instead of two conventional butterfly valves, a compact and less expensive EBV is provided.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An exhaust bypass valve assembly for a vehicle, the assembly comprising:

a housing defining an inlet passageway and first and second passageways in communication with the inlet passageway and with each other, and a bore at a juncture of the passageways and in communication with the passageways, the inlet passageway being constructed and arranged to receive exhaust gas from an exhaust manifold of a vehicle, the first passageway being constructed and arranged to be associated with a cooler of the vehicle and the second passageway being constructed and arranged to be associated with an engine of the vehicle, an exhaust bypass valve cartridge comprising:

a valve member removably disposed in the bore of the housing, and shaft structure associated with the valve member so that rotation of the shaft structure rotates the valve member, the valve member being movable between first and second positions such that when the valve member is in the first position, the inlet passageway only communicates with the first passageway so that exhaust gas can be directed to the cooler, and when the valve member is in a second position, the inlet passageway only communicates with the second passageway so that exhaust gas can be directed to the engine, wherein bore is generally cylindrical and the valve member is cylindrical having cutout that defines a U-shape of the valve member with first and second sides and a valve portion joined between the first and second sides, the valve portion substantially blocking exhaust gas flow and the cutout permitting exhaust gas flow past the valve member.

2. The assembly of claim 1, wherein the shaft structure includes a first shaft coupled with the first end of the valve member and a second shaft coupled with the second end of the valve member.

3. A method of providing a removable exhaust bypass valve cartridge for an exhaust bypass valve assembly of a vehicle, the method comprising:

providing a housing defining an inlet passageway and first and second passageways in communication with the inlet passageway and with each other, and a bore at a juncture of the passageways and in communication with the passageways, the inlet passageway receiving exhaust gas, the first passageway being associated with a cooler of a vehicle and the second passageway being associated with an engine of a vehicle, providing an exhaust bypass valve as a cartridge, the cartridge comprising a valve member and shaft structure associated with the valve member so that rotation of the shaft structure moves the valve member, and inserting the valve member into the bore in such a manner that the valve member is removable from the bore, with the shaft structure being accessible to be rotated such that rotation of the shaft moves the valve member to control a flow of exhaust gas from the inlet passageway through the first and second passageways, wherein the bore is generally cylindrical and the valve member is cylindrical having cutout that defines a U-shape of the valve member with first and second sides and a valve portion joined between the first and second sides, the valve portion substantially blocking exhaust gas flow and the cutout permitting exhaust gas flow past the valve member.

4. The method of claim 3, further including rotating the shaft to move the valve member between first and second positions such that when the valve member is in the first position, exhaust gas in the inlet passageway is substantially prevented from flowing through the second passageway and flows through the first passageway to be directed to the cooler, and when the valve member is in a second position, exhaust gas in the inlet passageway is substantially prevented from flowing through the first passageway and flows through the second passageway to be directed to the engine.

5. The method of claim 4, wherein the bore is generally cylindrical.

6. An exhaust bypass valve cartridge for an exhaust bypass valve (EBV) assembly, the EBV assembly having a housing defining an inlet passageway and first and second passageways in communication with the inlet passageway and with each other, and a bore at a juncture of the passageways and in communication with the passageways, cartridge comprising:

a valve member constructed and arranged to be removably inserted into the bore of the housing, and shaft structure associated with the valve member so that rotation of the shaft structure rotates the valve member, such that when the valve member is in a first position, the inlet passageway communicates only with the first passageway, and when the valve member is in a second position, the inlet passageway communicates only with the second passageway, wherein the valve member is cylindrical having a cutout that defines a generally U-shaped valve member with first and second sides and a valve portion joined between the first and second sides, the valve portion being constructed and arranged to substantially block exhaust gas flow and the cutout being constructed and arranged to permit exhaust gas flow past the valve member.

7. The cartridge of claim 2, wherein the shaft structure includes a first shaft coupled with the first end of the valve member and a second shaft coupled with the second end of the valve member.

8. The cartridge of claim 6, in combination with the housing, the valve member being received in the bore of the housing so as to be selectively removable from the bore.

9. The combination of claim 8, wherein the bore is generally cylindrical.

10. The combination of claim 9, wherein the shaft structure includes a first shaft coupled with the first end of the valve member and a second shaft coupled with the second end of the valve member.

* * * * *